US005559567A

United States Patent [19]

Kolton et al.

[11] Patent Number: 5,559,567

[45] Date of Patent: Sep. 24, 1996

[54] EYEGLASSES HANGER

[75] Inventors: Chester Kolton, Westfield; Stuart S. Spater, Livingston, both of N.J.

[73] Assignee: B&G Plastics, Inc., Newark, N.J.

[21] Appl. No.: 366,254

[22] Filed: Dec. 29, 1994

[51] Int. Cl.[6] ..... G02C 1/00

[52] U.S. Cl. ..... 351/158; 248/902; 211/59.1

[58] Field of Search ..... 351/41, 155, 158; 248/309.1, 317, 902, 690, 340; 211/13, 59.1; 206/5; 243.3/3 C

[56] References Cited

U.S. PATENT DOCUMENTS 5,129,617 7/1992 MacWilliamson ..... 248/690
5,340,074 8/1994 Porcaro et al. ..... 248/309.1

*Primary Examiner*—William L. Sikes
*Assistant Examiner*—Huy Mai
*Attorney, Agent, or Firm*—Robin, Blecker, Daley & Driscoll

[57] ABSTRACT

A hanging arrangement comprises eyeglasses inclusive of a bow supporting lenses aside a nose bridge thereof, the bow defining first and second temple supports at first and second ends thereof, and first and second temples joined respectively with the first and second temple supports and a hanger secured with the eyeglasses and hanging the eyeglasses with the first and second temple supports in vertical alignment. The hanger is comprised of a one-piece molded plastic body comprising a display portion having an opening therethrough for receipt of a display rod and a tail depending from the display portion, the tail having first and second successive segments, the first segment having an opening therethrough, the second segment having a reduced thickness portion with a central opening.

26 Claims, 4 Drawing Sheets

EYEGLASSES HANGER

FIELD OF THE INVENTION

This invention relates generally to article hangers and pertains more particularly to hangers for the hanging of eyeglasses.

BACKGROUND OF THE INVENTION

For reference purposes, applicants define "eyeglasses" as including "lenses" a "bow" for supporting the lenses and including a "nose bridge" centrally thereof and "temple supports" at opposite lateral ends thereof, and eyeglass "temples" which are rotatively supported by the temple supports and comprise side supports for the eyeglasses passing on each side of the user's head.

U.S. Pat. Nos. 5,144,345, 5,260,726 and 4,976,532 relate to the hangers for hanging eyeglasses such that they are horizontal, i.e., as they appear when worn. Plural hangers with eyeglasses are commonly mounted on a cantilever-supported display rod, the hangers having an opening shaped jointly with the rod to impart the horizontal disposition to the eyeglasses.

The manner of hanging of eyeglasses in the referenced patents is seen by applicants to have the disadvantage of the hanger being attached to the nose bridge and preventing the potential purchaser from viewing the eyeglasses, either on the display rod or removed and worn, without also viewing the hanger.

SUMMARY OF THE INVENTION

A primary object of the subject invention is to provide improved hangers for eyeglasses.

A particular object of the invention is to provide a hanger for eyeglasses which permits a potential purchaser to fully view the bow of the eyeglasses, inclusive of its temple supports, without also viewing the hanger.

In attaining these and other objects, the invention provides, in combination, in a first aspect, eyeglasses inclusive of a bow supporting lenses aside a nose bridge thereof, the bow defining first and second temple supports at first and second ends thereof, and first and second temples joined respectively with the first and second temple supports and a hanger secured with the eyeglasses and hanging the eyeglasses with the first and second temple supports in vertical alignment. The combination further including a hanger support rod, the hanger defining an opening therethrough, the hanger support rod being resident in the hanger opening.

The invention provides, in combination, in a second aspect, eyeglasses inclusive of a bow supporting lenses aside a nose bridge thereof, the bow defining first and second temple supports at first and second ends thereof, and first and second temples joined respectively with the first and second temple supports and a hanger secured with the eyeglasses at the location of joinder of the first temple and the first temple support.

In a first hanger aspect, the invention provides a hanger comprised of a one-piece molded plastic body comprising a display portion having an opening therethrough for receipt of a display rod and a tail depending from said display portion, the tail having at least first and second successive segments and a hinge part between the first and second segments.

In a second hanger aspect, the invention provides a hanger comprised of a one-piece molded plastic body comprising a display portion having an opening therethrough for receipt of a display rod and a tail depending from the display portion, the tail having first and second successive segments, the first segment having an opening therethrough, the second segment having a reduced thickness portion with a central aperture.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figure 2:
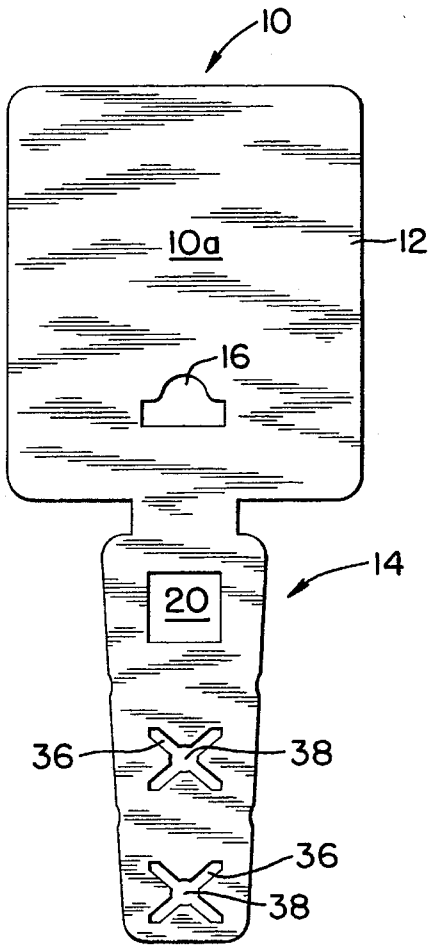
FIG. 2 is a rear elevation of the FIG. 1 hanger.
Figure 1:
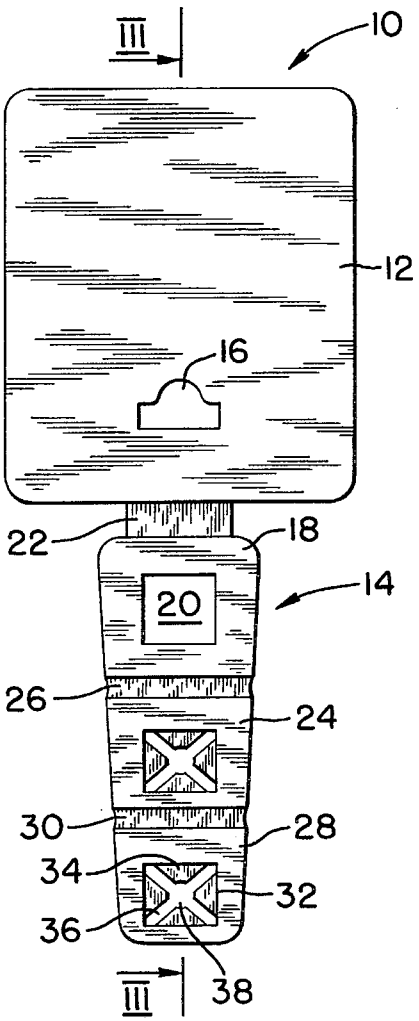
FIG. 1 is a front elevation of a hanger in accordance with the invention.
Figure 3:
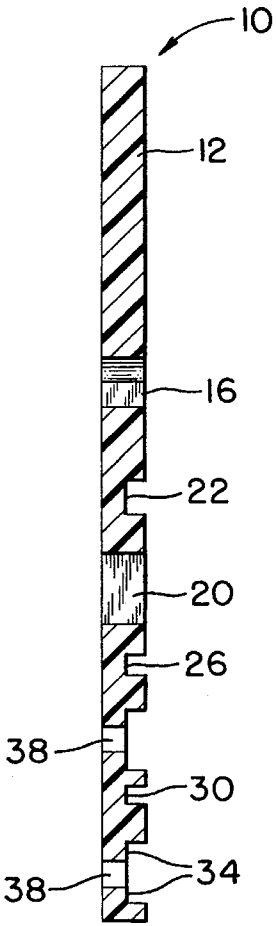
FIG. 3 is a sectional view of the FIG. 1 hanger as would be seen from plane III—III of FIG. 1.

Referring to FIGS. 1–3, hanger 10 is constituted as a one-piece molded plastic body having a display portion 12 and a tail 14. Display portion 12 has and opening 16 adapted for receipt of a display rod.

Tail 14 has a first segment 18 which depends from display portion 12 and defines an opening 20. Tail part 22 between display portion 12 and first tail segment 18 is of common thickness with first tail segment 18, whereby first tail segment 18 is non-pivotally supported with respect to display portion 12.

A second tail segment 24 depends from first tail segment 18 and is pivotally supported by first tail segment 18 by a hinge part 26, which, for such purpose, is of a lessened thickness with respect to first segment 18.

A third tail segment 28 depends from second tail segment 24 and is pivotally supported by second tail segment 24 by a hinge part 30, which, again for such purpose, is of a lessened thickness with respect to second segment 24.

Each of tail segments 24 and 28 is configured to permit a temple to pass therethrough and to then be frictionally associated therewith. To this end, for segment 28, interior portion 32 has four triangularly-shaped areas 34 which are of thickness comparable to the reduced thickness of hinges 26 and 30. Line openings 36 are formed between respective areas 34 to form a cruciform having central circular aperture 38.

As is evident from FIG. 2, rear surface 10a of hanger 10 is continuous and unapertured, other than for openings 16, extending through display portion 12 and 20, extending through tail first segment 18 and apertures 38 and line openings 36 extending through tail segments 24 and 28.

Figure 4:
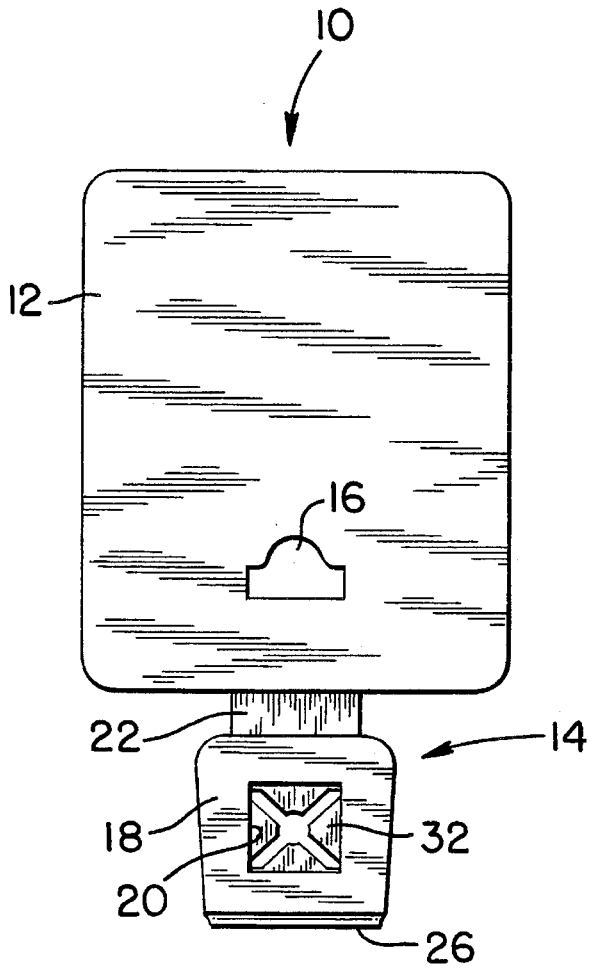
FIG. 4 is a front elevation of the FIG. 1 hanger with its tail folded.
Figure 5:
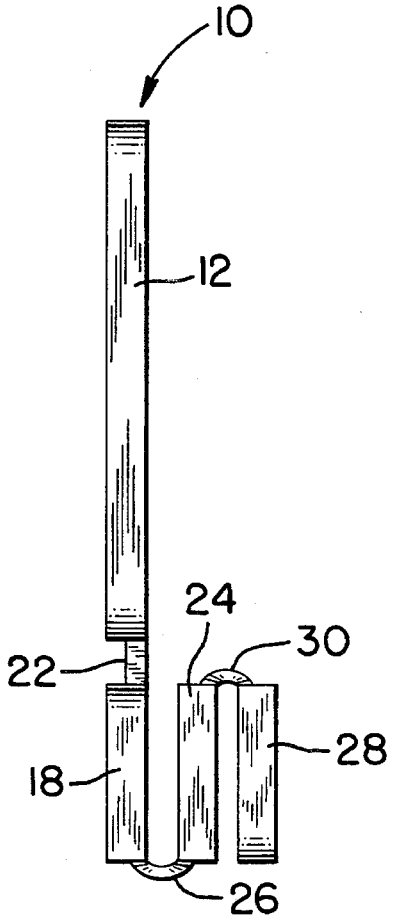
FIG. 5 is a right side elevation of FIG. 4.
Figure 6:
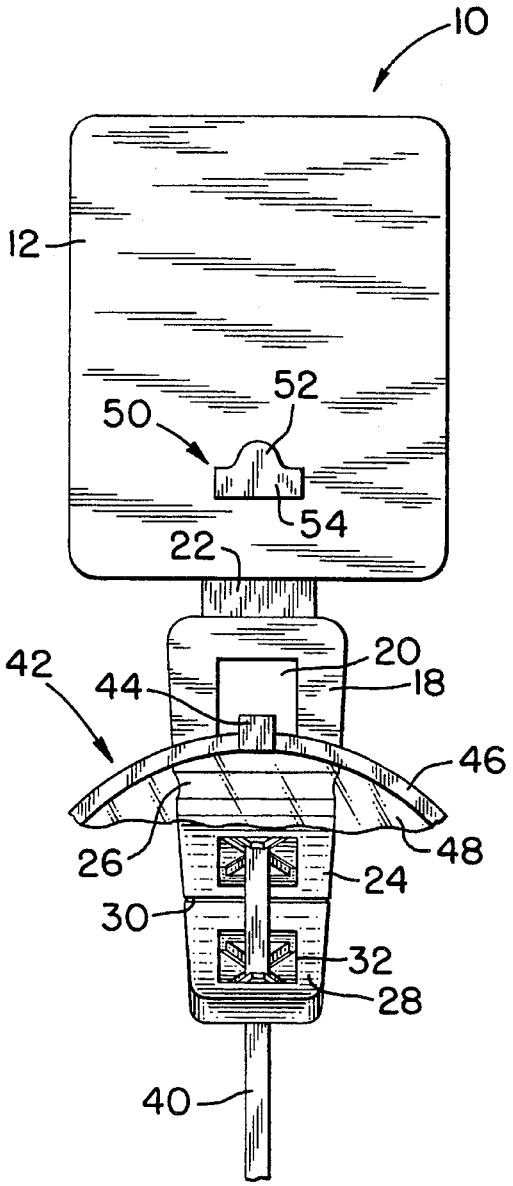
FIG. 6 is a front elevation of the FIG. 1 hanger with eyeglasses hung thereby from a display rod.

In preparing hanger 10 for assembly with a temple, tail 14 is folded as is shown in FIGS. 4 and 5, whereby interior portion 32 of tail segment 24 is in positional registry with opening 20 of tail segment 18. Interior portion 32 of segment 28, not seen in FIG. 4, is in positional registry with opening 20 of tail segment 18 and with interior portion of tail segment 24. Temple 40 (FIG. 6) has its free end forced into opening 20 and through interior portions 32 of segments 24 and 28 to yield the assembly shown in FIGS. 6 and 7, to which reference is now made.

Figure 7:
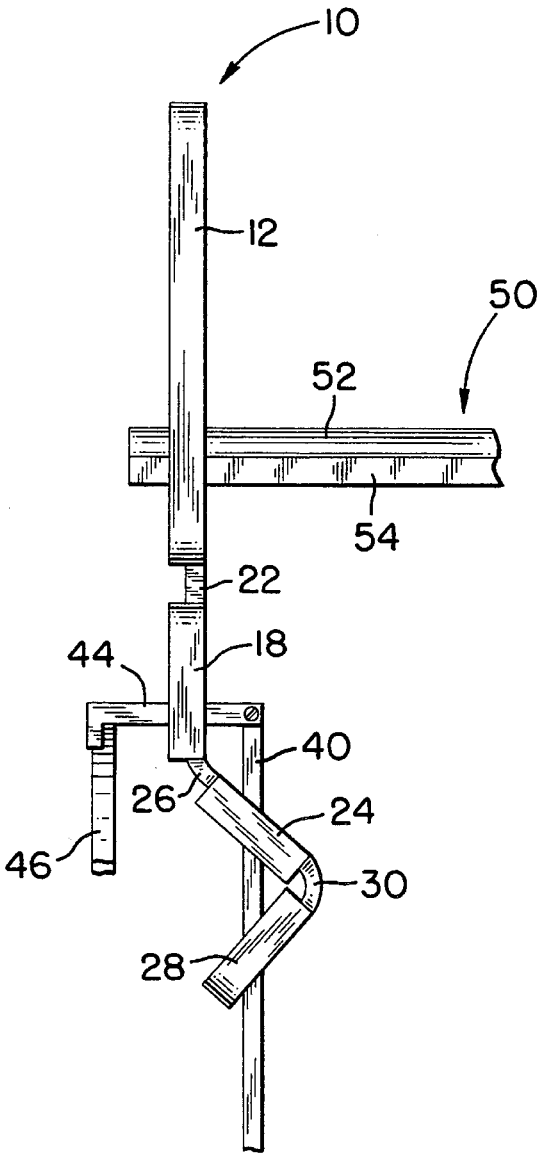
FIG. 7 is a right side elevation of FIG. 6.

Eyeglasses 42 include temple 40, temple support 44, bow 46 and lens 48. Temple support 44 is disposed in opening 20 of tail segment 18. In the hung disposition, temple 40 is pivoted to be at a right angle to temple support 44 and is thus dressed along bow 46, rearwardly thereof. Temple 40 extends through interior portions 32 of tail segments 24 and 28 and frictionally engages areas 34 of the same. As is seen in FIG. 7, segments 24 and 28 make substantially forty-five degree angles with respect to temple 40. Support member 50 has upper arcuate part 52 and beam 54, thus configured to receive hanger display portion 12 and to reside in opening 16 thereof.

Figure 8:
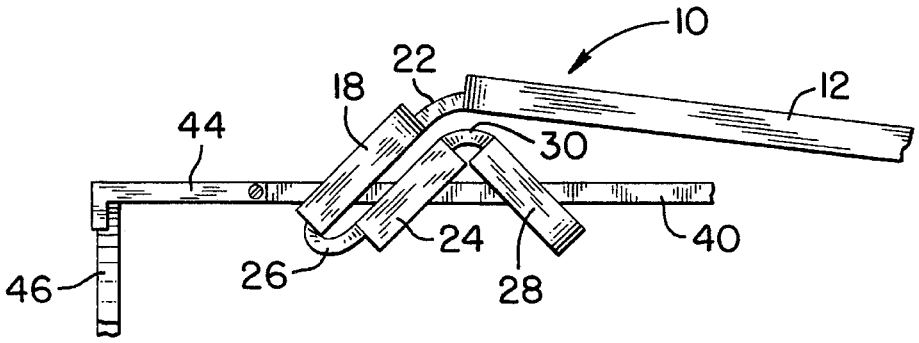
FIG. 8 is a partial side view of the hanger of FIG. 1 in assembly with a temple of the FIG. 6 eyeglasses and disposed such that a user can view the full bow thereof with the hanger still attached.

In FIG. 8, hanger 10 is removed from support member 50, remaining in assembly with temple 40. Display portion 12 is displaced to be dressed along temple 40. As such, tail segment 24 is now in facing relation to segment 28 and display portion 12 is in facing relation to temple 40.

As will be appreciated, the entirety of bow 46, lens 48 and temple support 44 can be seen when the potential purchaser tries on the eyeglasses. Thus, opening 20 is sized, as is tail segment 18, to permit passage therethrough of temple support 44. Further enabling this desirable result is the arrangement of the multiple mutually pivotal tail segments. To return the hanger and eyeglasses to support member 50, one simply retrieves the relation of parts to that shown in FIGS. 6 and 7.

Figure 11:
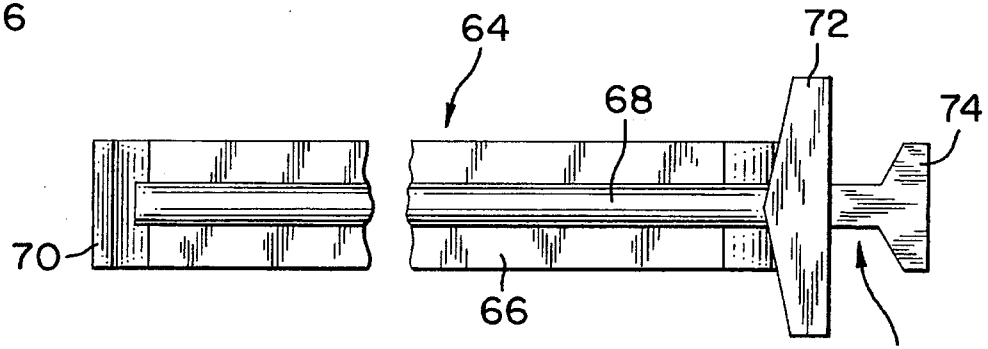
FIG. 11 is a top plan view of FIG. 11.
Figure 10:
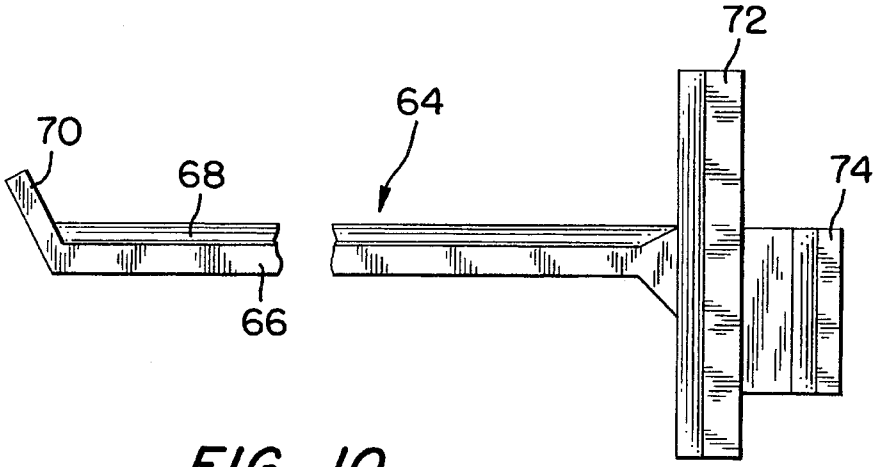
FIG. 10 is side elevation of a display rod for use with the hanger of FIG. 10.
Figure 9:
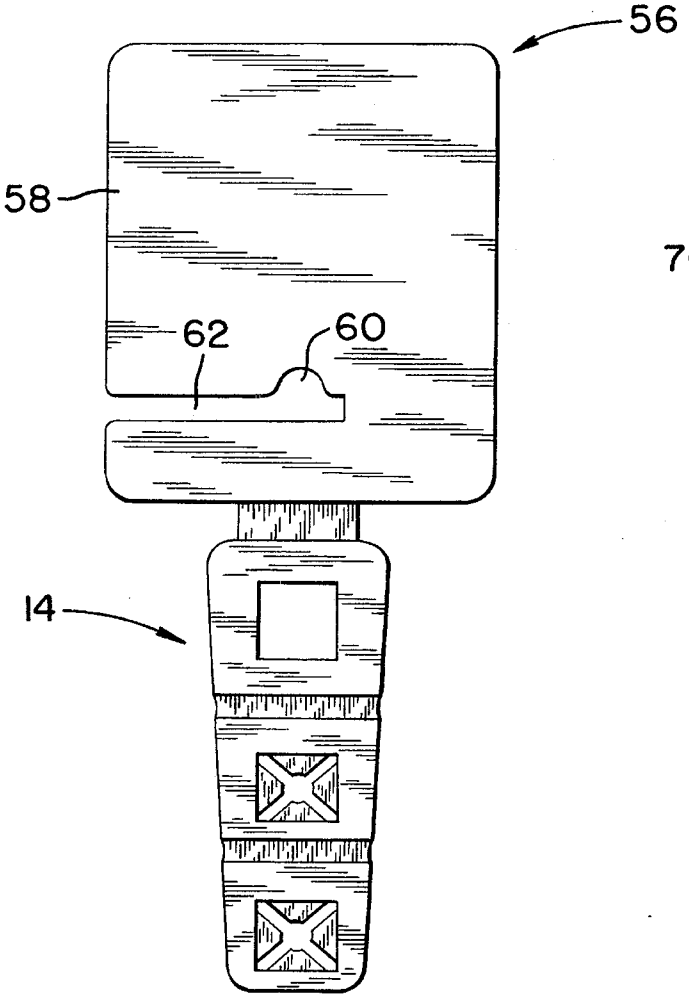
FIG. 9 is a front elevation of a second embodiment of a hanger in accordance with the invention.

Turning to FIGS. 9–11, hanger 56 includes display portion 58, which has opening 60 therethrough and a channel 62 extending from opening 60 and opening into the left side margin of display portion 58. Hanger 56 is otherwise identically configured with hanger 10, i.e., it has tail 14.

Support member 64 has beam 66 and arcuate upper portion 68 and both thereof are terminated at one end with inclined member 70. The cross-section of beam 66 and arcuate upper portion 68 is complemental to opening 60 of display portion 58. At its other end, support member has structure for hanging the same in cantilever fashion of a known display rack (not shown), i.e., arms 72 and 74 with nest 76 therebetween.

Hanger 56 is applied to support member 64 by aligning a side of beam 66 with channel 62 and deflecting the upper part of display portion 58 sufficiently to permit passage of the beam and arcuate upper portion 68 into opening 60 and then allowing the upper part of display portion to self-biasingly return to the plane of the hanger. Inclined member 70 and arm 72 provide for horizontal retention of hangers with support member 64 in the absence of such removal thereof. As will be appreciated, reversal of these steps will permit return of the hanger to a supported situation.

Various changes to the particularly disclosed embodiments and methods may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. In combination:

(a) eyeglasses inclusive of a bow supporting lenses aside a nose bridge thereof, said bow defining first and second temple supports at first and second ends thereof, and first and second temples joined respectively with said first and second temple supports; and (b) an upstanding hanger secured with said eyeglasses and hanging said eyeglasses with said first and second temple supports in vertical alignment, said hanger comprising a display portion and a tail portion depending from said display portion and extending in engagement with said first temple, the entirety of said tail portion extending vertically downwardly of said display portion.

2. The invention claimed in claim 1, further including a hanger support rod, said hanger defining an opening therethrough, said hanger support rod being resident in said hanger opening.

3. The invention claimed in claim 1, wherein said tail portion has a first segment which defines an opening in which said first temple support is resident.

4. The invention claimed in claim 3, wherein said tail portion first segment is supported by said display portion by a tail part of lessened thickness with respect to said tail portion first segment.

5. The invention claimed in claim 3, wherein said tail portion has a second segment having an aperture therethrough, said first temple being resident in said tail portion second segment aperture.

6. The invention claimed in claim 5, wherein said tail portion second segment is pivotally supported by said tail portion first segment.

7. The invention claimed in claim 6, wherein said tail portion first segment is non-pivotally supported by said display portion.

8. The invention claimed in claim 5, wherein said tail portion has a third segment having an aperture therethrough, said first temple being resident in said tail portion third segment aperture.

9. The invention claimed in claim 8, wherein said tail portion third segment is pivotally supported by said tail portion second segment.

10. The invention claimed in claim 9, wherein said tail portion first segment is non-pivotally supported by said display portion.

11. The invention claimed in claim 10, wherein said tail portion second segment is pivotally supported by said tail portion first segment.

12. The invention claimed in claim 1, wherein said tail portion retentively engages said first temple at plural spaced locations thereon.

13. In combination:

(a) eyeglasses inclusive of a bow supporting lenses aside a nose bridge thereof, said bow defining first and second temple supports at first and second ends thereof, and first and second temples joined respectively with said first and second temple supports; and (b) an upstanding hanger having a display portion and a tail portion hinged to and depending from said display portion, said tail portion being secured with said eyeglasses at the location of joinder of said first temple and said first temple support, said tail portion extending in engagement with said first temple, the entirety of said tail portion extending vertically downwardly of said display portion.

14. The invention claimed in claim 13, further including a hanger support rod, said hanger defining an opening therethrough, said hanger support rod being resident in said hanger opening.

15. The invention claimed in claim 13, wherein said tail portion retentively engages said first temple at plural spaced locations thereon.

16. A hanger comprised of a one-piece molded plastic body comprising a display portion having an opening therethrough for receipt of a display rod and a tail depending from said display portion, said tail having first, second and third successive segments having respective first, second and third openings therethrough and first and second hinge parts, said first hinge part being disposed between said first and second segments, said second hinge part being disposed between said second and third segments.

17. The hanger claimed in claim 16, wherein said hanger includes a part between said display portion and said tail of lessened thickness with respect to said first tail segment.

18. A hanger comprised of a one-piece molded plastic body comprising a display portion having an opening therethrough for receipt of a display rod and a tail depending from said display portion, said tail having first and second successive segments, said first segment having an opening therethrough, said second segment having a reduced thickness portion with a central aperture.

19. The hanger claimed in claim 18, further including a part between said display portion and said tail first segment of lessened thickness with respect to said tail first segment.

20. The hanger claimed in claim 19, including a hinge part between said tail first segment and said tail second segment.

21. The hanger claimed in claim 18, further including a third tail segment having a reduced thickness portion with a central aperture.

22. The hanger claimed in claim 21, further including a part between said display portion and said tail first segment of lessened thickness with respect to said tail first segment.

23. The hanger claimed in claim 22, including a hinge part between said tail first segment and said tail second segment.

24. The hanger claimed in claim 23, including another hinge segment between said tail second segment and said tail third segment.

25. The hanger claimed in claim 24 wherein said second segment reduced thickness portion further includes line openings extending into said central aperture.

26. In combination:

(a) eyeglasses inclusive of a bow supporting lenses aside a nose bridge thereof, said bow defining first and second temple supports at first and second ends thereof, and first and second temples joined respectively with said first and second temple supports; and (b) an upstanding hanger secured with said eyeglasses and hanging said eyeglasses with said first and second temple supports in vertical alignment, said hanger comprising a display portion and a tail portion depending from said display portion and extending in engagement with said first temple, said tail portion having segments successively vertically downwardly of said engagement thereof with said first temple on opposed sides of said first temple.

* * * * *